United States Patent [19]

Yoshida et al.

[11] 4,385,613

[45] May 31, 1983

[54] AIR-FUEL RATIO FEEDBACK CONTROL SYSTEM

[75] Inventors: Shuzo Yoshida, Anjo; Hiroki Matsuoka, Susono; Susumu Nogami, Toyota; Hironobu Ono, Toyota; Motoharu Sueishi, Toyota; Kazuo Ueda, Kariya, all of Japan

[73] Assignees: Nippondenso Co., Ltd., Kariya; Toyota Jidosha Kogyo Kabushiki Kaisha, Toyota, both of Japan

[21] Appl. No.: 300,593

[22] Filed: Sep. 9, 1981

[30] Foreign Application Priority Data

Sep. 12, 1980 [JP] Japan ..... 55-127629

[51] Int. Cl.[3] ..... F02D 5/00

[52] U.S. Cl. ..... 123/489; 123/491; 123/440; 60/276

[58] Field of Search ..... 123/489, 491, 440, 179 G, 123/179 L; 60/276, 285

[56] References Cited

U.S. PATENT DOCUMENTS

| | | | |
|---|---|---|---|
| 3,949,551 | 4/1976 | Eichler et al. | 60/274 |
| 4,040,408 | 8/1977 | Kraus et al. | 123/489 |
| 4,096,834 | 6/1978 | Norimatsu et al. | 123/489 |
| 4,100,892 | 7/1978 | Asano | 123/440 |
| 4,252,098 | 2/1981 | Tomczak et al. | 123/440 |

*Primary Examiner*—Charles J. Myhre
*Assistant Examiner*—Andrew M. Dolinar
*Attorney, Agent, or Firm*—Cushman, Darby & Cushman

[57] ABSTRACT

An air-fuel ratio feedback control system is disclosed in which a sensing output representing the oxygen concentration in the exhaust gas of an internal combustion engine is compared with a predetermined set value. The output of the comparator is integrated and the amount of fuel injection is corrected by being increased or decreased in accordance with the integration output having an increasing or decreasing polarity so as to control the air-fuel ratio at a stoichiometrical value. At the time of engine start, the air-fuel ratio feedback control is stopped, and this condition is held after engine start. Further, the holding function is cancelled by a signal representing the activation of the detection output of the oxygen sensor.

5 Claims, 4 Drawing Figures

AIR-FUEL RATIO FEEDBACK CONTROL SYSTEM

BACKGROUND OF THE INVENTION

The present invention relates to an air-fuel ratio feedback control system for correctively controlling the air-fuel ratio of the mixture supplied to an internal combustion engine in accordance with the oxygen concentration in the exhaust gas, or more in particular to an improvement in the control characteristic immediately after engine start before warm up of the internal combustion engine.

A conventional system is well known which, for the purpose of purification of the exhaust gas, correctively controls the air-fuel ratio of the mixture by feeding back the oxygen concentration of the exhaust gas in the exhaust system of the internal combustion engine to the intake system.

Immediately after the engine start before warm up of the internal combustion engine, the oxygen sensor is still inactive and is incapable of actuating the air-fuel feedback control. Generally, before the temperature of the engine cooling water is increased to a predetermined level, the air-fuel ratio feedback control is stopped and an open loop condition is set.

At the time of engine restart or the like, the temperature of the engine cooling water is high and the ambient temperature of the oxygen sensor is low, so that the oxygen sensor is inactive. An activity monitor circuit is provided for monitoring the active or inactive state of the oxygen sensor. When the oxygen sensor shows an inactive state for a predetermined length of time, the operation of the activity monitor circuit is required to stop the air-fuel ratio feedback control and to set an open loop condition.

Demand is high for a system in which the operating region of the air-fuel ratio feedback control is widened against the engine operating region to effect purification of the exhaust gas at higher efficiency and the air-fuel ratio of the mixture gas is correctively controlled by feeding back the oxygen concentration in the exhaust gas in the exhaust system of the internal combustion engine to the intake system without any problem.

It is possible to start the air-fuel feedback control earlier before warm up of the engine by setting a lower temperature of the cooling water for feedback start. If the temperature of the cooling water is used for determining the time of activation of the oxygen sensor, however, the shortcoming is that it is impossible to set a predetermined temperature of the cooling water for starting the feedback control when the cooling conditions of the engine are not stable. If the operating region of the feedback control is broadened without the activity monitor circuit, on the other hand, an erroneous feedback control is effected thereby to adversely affect the operating performance, exhaust gas purification and the like characteristics under the inactive state of the oxygen sensor.

SUMMARY OF THE INVENTION

The present invention has been developed in view of the above-mentioned disadvantages, and an object of this invention is to provide an air-fuel feedback control system comprising a holding circuit for stopping the air-fuel ratio feedback control at the time of engine start and holding the particular state after engine start and cancelling means for cancelling the holding function of the holding circuit in response to an activation signal produced from the oxygen sensor, wherein immediately after activation of the oxygen sensor, the air-fuel ratio feedback control is started, so that under the engine running condition, especially, in the running mode before warm up, the exhaust gas (especially CO) is purified with high efficiency while at the same time attaining a high operating performance.

DESCRIPTION OF THE PREFERRED EMBODIMENTS

Figure 1:
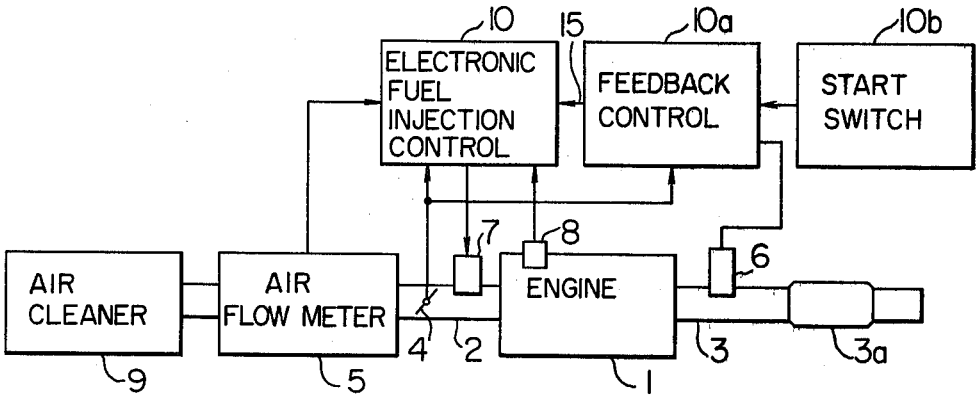
FIG. 1 is a block diagram showing a general configuration of an air-fuel feedback control system.

An embodiment of the present invention shown in the drawings will be explained. In the block diagram of FIG. 1 showing a fuel injection control system of air-fuel ratio feedback type, reference numeral 1 designates an engine body of the internal combustion engine, numeral 2 an intake manifold, numeral 3 an exhaust manifold, and numeral 4 a throttle valve having a detection switch 4*a* (not shown) for detecting the fully closed state of the throttle valve 4. Numeral 5 designates an air flow meter disposed on the front of the intake manifold 2 for metering the air flow introduced into the engine. Numeral 6 designates an oxygen sensor made from such a solid electrolyte as zirconia and arranged in the exhaust manifold 3 for detecting the oxygen concentration in the exhaust gas. When the temperature of the exhaust gas exceeds the tolerable temperature range from 450° C. to 600° C., the oxygen sensor normally operates in response to the oxygen concentration and produces a concentration detection signal. Numeral 7 designates an injection valve for injecting the fuel into the intake manifold 2, which injection valve is opened by the fuel injection pulse signal produced from the electronic fuel injection control unit 10. Numeral 8 designates engine condition detector for detecting the engine conditions including the engine rotational speed and numeral 9 an air cleaner.

Numeral 10 designates an electronic fuel injection control unit for producing a fuel injection pulse signal of a predetermined time width for opening the injection valve 7 in order to supply the fuel of an amount commensurate with the outputs of the air flow meter 5 and the engine condition detector 8 by way of the injection valve 7. Numeral 10*a* designates a feedback control circuit for correcting by feedback the amount of fuel injection determined by the electronic fuel injection control unit 10 in accordance with the oxygen concentration detection signal produced from the oxygen concentration detector 6. This feedback control circuit 10*a* and the control means 10 make up a computer. When the output of this feedback control circuit 10*a* takes the reference value of $+B/2$ which is half the source voltage $+B$, the amount of correction of the feedback control system is reduced to zero thereby to inject the predetermined basic amount of fuel in what is called the open loop state. In the feedback control state, on the other hand, the feedback control circuit 10*a* operates in such a manner as to reduce the time width of the fuel injection pulse when the output thereof is lower than the reference voltage +B/2, while when the output of the feedback control circuit 10*a* is higher than the reference voltage +B/2, the time width of the fuel injection pulse is lengthened thereby to correct the amount of fuel injection. Numeral 10*b* designates a start switch for applying a start signal to a starter motor for the engine and the feedback control circuit 10*a*. Numeral 3*a* designates a catalyst, or specifically, a three-way catalyst having the air-fuel ratio region of high purification rate approximate to the ideal air-fuel ratio for the three components of nitrogen oxide NOx, hydrocarbon HC and carbon dioxide CO in the exhaust gas.

Figure 2A:
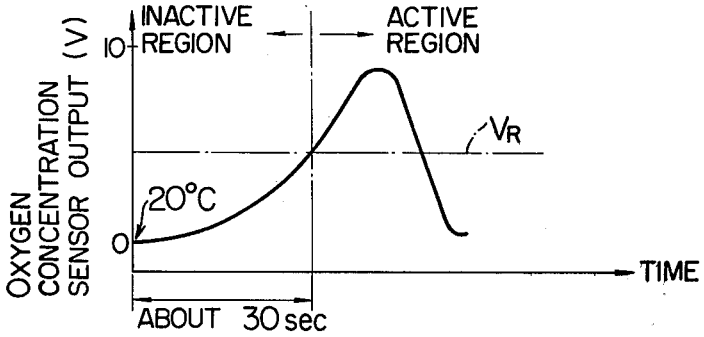
FIGS. 2(A) and 2(B) are condition transfer diagrams showing the transfer from inactive state to active state of the output of the oxygen sensor from the engine temperature of 20° C. and the transfer of the output of the oxygen sensor of the engine warmed up from the cooling water temperature of 20° C. respectively.
Figure 2B:
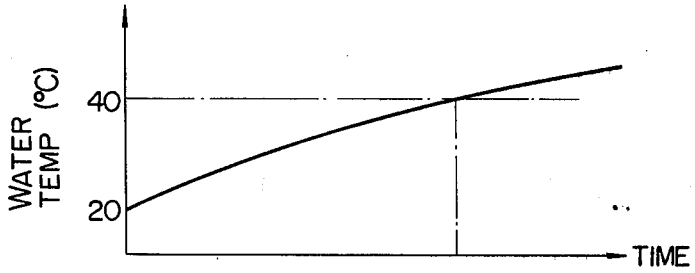
Figure 3:
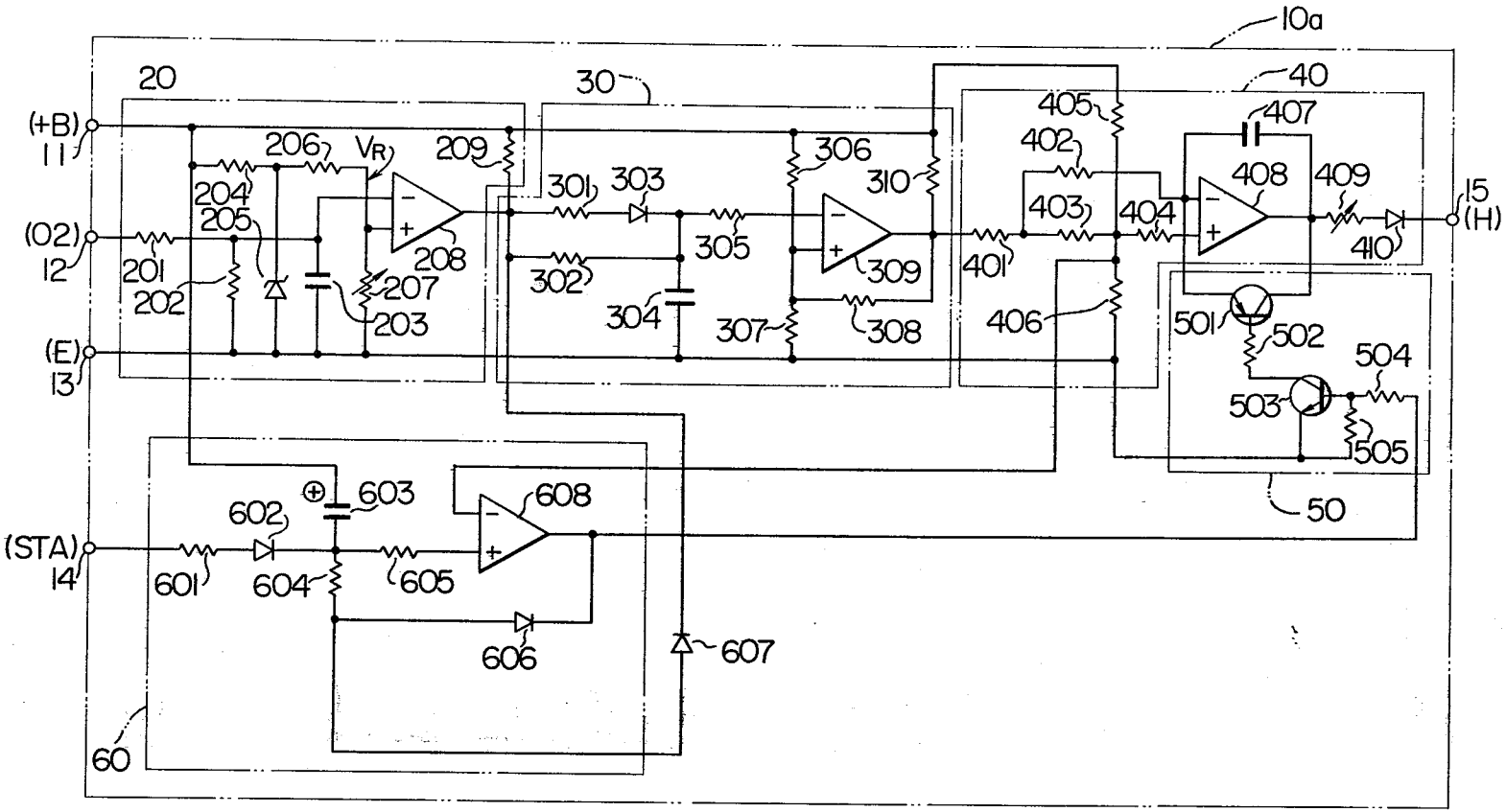
FIG. 3 is an electrical connection diagram showing an air-fuel ratio feedback control system making up one of the essential parts of the present invention.

FIGS. 2A and 2B show the results of experiments conducted by the inventors, respectively illustrating the condition transfer from inactive to active state of the output of the oxygen sensor from the engine temperature of 20° C. and the condition transfer of the engine warmed up from the cooling water temperature of 20° C. FIG. 3 shows a specific example of the feedback control circuit 10*a* making up one of the essential parts of the present invention. In FIG. 3, numeral 11 designates a battery terminal (+B), numeral 12 an input terminal (02) of the oxygen sensor, numeral 13 a grounding terminal (E), and numeral 14 a starter signal terminal (STA) supplied with high level signal (high level signal being substantially equal to +B level, and the low level signal equal to E level) at the time of engine start. Numeral 15 designates a fuel amount change terminal (h). Numeral 20 designates an air-fuel ratio decision circuit for discriminating the output of the oxygen sensor, which circuit 20 produces a low level signal for a rich state of the air-fuel ratio and a high level signal for a lean state thereof. Numeral 30 designates a delay circuit for delaying the output signal of the air-fuel ratio decision circuit 20, and numeral 40 a integrator circuit for producing an integrated output changing with the output of the delay circuit 30. The output of the integrator circuit 40 is applied from the fuel change terminal (H) 15 to the fuel change function not shown. Numeral 50 designates an open loop setting circuit, and numeral 60 a holding circuit making up one of the essential parts of the present invention.

In the air-fuel ratio decision circuit 20, numeral 201 designates an input resistor for the comparator 208, numeral 202 a grounding resistor for grounding the output of the oxygen sensor, numeral 203 a noise-erasing capacitor, numeral 204 a zener resistor, numeral 205 a zener diode, and numerals 205 and 206 dividing resistors for dividing the Zener voltage into a predetermined voltage $V_R$. Numeral 209 designates a pull-up resistor for the comparator 208. In the dealy circuit 30, numeral 301 designates a charging resistor, numeral 302 a charge or discharge resistor, numeral 303 a reverse current blocking diode, numeral 304 a charge-discharge capacitor, numeral 305 an input resistor for the comparator 309, numerals 306 and 307 dividing resistors, numeral 308 a hysteresis resistor, and numeral 310 a pull-up resistor for the comparator 309. In the integrator circuit 40, numerals 401, 403 and 404 designate input resistors for the integrator circuit 408, numerals 405 and 406 resistors for setting the middle-point potential (=+B/2), numeral 407 an integrating capacitor, numeral 409 a resistor for setting the amount of change of the fuel, and numeral 410 a reverse current flow blocking diode. In the open setting circuit 50, numeral 501 designates an open setting transistor which when conducted, conducts the negative terminal and the output terminal of the integrator 408, so that the output of the integrator 408 is fixed at the middle point potential (=+B/2) thereby to reduce the amount of fuel change to zero. Numeral 502 designates a base resistor for the transistor 501, and numeral 503 a switching transistor. When the transistor 503 conducts, the open setting transistor 501 also conducts. Numeral 504 designates a base resistor for the switching transistor 503, and numeral 505 a base leak resistor.

In the holding circuit 60, numeral 601 designates a charging resistor, numeral 605 an input resistor for the comparator 608, numeral 602 a reverse current blocking diode, numeral 604 a discharge resistor, and numeral 606 a feedback diode for stabilizing the high level output signal of the comparator 608. Numeral 607 designates a cancelling diode for resetting the high level output of the comparator 608.

The operation of the circuit having the above-mentioned configuration will be described. First, as seen from FIGS. 2A and 2B showing the transfer from the inactive to active state of the output of the oxygen sensor and the change in the engine cooling water temperature during the engine warm up respectively, the time required for attainment of the active state of the output of the oxygen sensor from 20° C. is different from the time required for attainment of the cooling water temperature of 40° C. for feedback start. Specifically, the time required for activation of the output of the oxygen sensor is shorter than the time required for the increase of the cooling water temperature. Therefore, the starting the feedback by the activation signal of the oxygen sensor is more desirable for the purpose of control of the air-fuel ratio.

Now, with reference to FIG. 3, explanation will be made about the function of air-fuel ratio feedback control, or more in particular about the holding function of stopping and holding the air-fuel ratio feedback control at the time of and after start of the engine and the function of cancelling this holding function by an activation signal of the oxygen sensor making up the essential parts of the present invention. In FIG. 3, the high level signal applied to the starter signal terminal (STA) 14 from the start switch 10*b* at the time of engine start is applied to the positive terminal of the comparator 608, thus fixing the output of the comparator 608 at high level. Even when the starter signal is reduced to low level after engine start, the high level of the output at the negative terminal of the starter signal holding capacitor 603 is never changed but the positive terminal of the comparator 608 is held at high level as long as the diode 602 is reversely biased, the input impedance of the comparator 608 is high and the input terminal of the comparator 608 is of flow-out input construction (only the source current is supplied such as when μPC451C of NEC is used). The high level thus held sets the output of the comparator 608 to high level, conducts the transistors 503 and 501 in the open setting circuit 50, fixes the output of the integrator 408 at the middle-point potential (=+B/2), and reduces the change of fuel amount due to feedback control output to zero in what is called open loop control mode.

Assuming that the oxygen sensor is inactive, the internal impedance of the oxygen sensor is very high. Since a grounding resistor 202 of several MΩ is provided in the air-fuel ratio decision circuit 20, however, a low level signal is applied to the negative terminal of the comparator 208 and the output of the comparator 208 is kept at high level. This signal reversely biases the diode 607 of the holding circuit 60, so that the high level holding voltage at the negative side of the starter signal holding capacitor 603 is held and the output of the comparator 608 is held at high level, thus keeping the open loop control mode.

With the progress of the oxygen sensor toward active state, the internal impedance thereof is reduced. When the internal impedance becomes negligibly small as compared with the grounding resistor 202, the output voltage of the oxygen sensor apparently increases slowly and exceeds the predetermined reference voltage $V_R$ (such as 0.45 V) at the air-fuel ratio decision circuit 20. When the oxygen sensor is activated, the output of the comparator 208 is reduced to low level, which low signal acts to connect the cancelling diode of the holding circuit 60 in forward direction. As a result, the negative side of the starter signal holding capacitor 603 is set to low level, the output of the comparator 608 is reset to low level, the transistors 501 and 503 of the open setting circuit 50 are cut off, and the open loop control is cancelled, thus starting the feedback control.

In the feedback control mode, the low level (the air-fuel being "rich") of the output of the air-fuel ratio decision circuit 20 or the high level signal (the air-fuel ratio being "lean") of the output thereof are delayed in rise or fall thereof respectively by the time constant due to the charge-discharge capacitor 304 and the resistors 301 and 302 of the delay circuit 30, so that the output compared at the comparator 309 is delayed behind the output signal of the comparator 208. In accordance with the high level (the air-fuel ratio being "rich") or the low level (the air-fuel ratio being "lean") of the output delayed by the comparator 309, the integrator 408 of the integrator circuit 40 produces a reversed integration output thereby to change the amount of fuel.

It will be understood from the foregoing description that according to the present invention the air-fuel ratio feedback control may be effected simultaneously with the starting of activation of the oxygen sensor. Further, once the feedback control is started, even if the inactive state of the oxygen sensor continues, the grounding resistor 202 of the air-fuel ratio decision circuit 20 maintains the apparently "lean" state of the output of the oxygen sensor, thus increasing the fuel amount by the air-fuel ratio feedback control. In this way, the engine stall or other driverbility are prevented.

In the above-mentioned embodiment, the holding function of stopping and holding the air-fuel ratio feedback control is provided by the comparator 608 of the holding circuit 60. As an alternative method, such a holding function may be provided by a D flip-flop (such as CD4013 of RCA) or an R-S flip-flop using a C-MOS NAND gate (such as CD4011 of RCA).

Further, the analog computer used in the above-mentioned embodiment may be replaced with equal effect by a microcomputer adapted to operate according to a stored program.

We claim:

1. A system for controlling the air-fuel ratio in an internal combustion engine including an oxygen sensor for detecting the oxygen concentration in the exhaust gas of the internal combustion engine, start switch means for generating a start signal for the internal combustion engine and a computer for controlling the amount of fuel supplied to the internal combustion engine in response to signals from said oxygen sensor and said start switch means wherein said computer comprises:

a section means including comparing means for comparing a detection signal from said oxygen sensor with a reference signal and integrating means for determining the change of fuel amount in accordance with the result of comparison at said comparing means, said section means effecting feedback control of the air-fuel ratio;

open setting means for stopping the feedback control of said feedback control section means;

holding means adapted to operate in response to the signal from said start switch means for actuating said open setting means and stopping the feedback control of said feedback control section means regardless of the engine temperature at the time of engine start, said holding means holding said condition after engine start; and cancelling means for monitoring the condition of said oxygen sensor and cancelling the holding function of said holding means when said oxygen sensor transfers from inactive state to active state, thus starting the feedback control by said feedback control section means.

2. A system according to claim 1, wherein said open setting means includes an open setting transistor connected in parallel to said integrator means, said transistor being turned on by a signal from said holding means.

3. A system according to claim 1, wherein said holding means includes a charging circuit having a capacitor and a resistor and a comparator circuit connected to said charging circuit.

4. A system according to claim 1, wherein said cancelling means includes a cancelling diode.

5. In a system including an oxygen sensor for detecting the oxygen concentration of an exhaust gas of an internal combustion engine and a computer for controlling the air-fuel ratio by processing the detection signal from said oxygen sensor, a method of controlling the air-fuel ratio comprising the steps of detecting an engine start, effecting the open-loop control of the air-fuel ratio regardless of the signal from said oxygen sensor at the time of engine start, holding the open-loop control of the air-fuel ratio after the engine start, detecting whether the oxygen sensor has transferred from an inactive state to an active state, and cancelling the holding function and starting the feedback control of the air-fuel ratio in response to the detection signal of said oxygen sensor when the oxygen sensor transfers to an active state.

* * * * *